US012226014B2

(12) United States Patent
Chen et al.

(10) Patent No.: US 12,226,014 B2
(45) Date of Patent: Feb. 18, 2025

(54) SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-Ho Yang, Kaohsiung (TW); Wei-Chen Chang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 63 days.

(21) Appl. No.: 18/190,430

(22) Filed: Mar. 27, 2023

(65) Prior Publication Data

US 2024/0115043 A1 Apr. 11, 2024

(30) Foreign Application Priority Data

Oct. 7, 2022 (TW) ..... 111138522

(51) Int. Cl.
*A47B 88/493* (2017.01)
*A47B 88/423* (2017.01)

(52) U.S. Cl.
CPC ..... *A47B 88/493* (2017.01); *A47B 88/423* (2017.01)

(58) Field of Classification Search
CPC ..... A47B 88/423; A47B 88/493
See application file for complete search history.

(56) References Cited

U.S. PATENT DOCUMENTS

| | | | | |
|---|---|---|---|---|
| 6,851,773 | B2 | 2/2005 | Chen et al. | |
| 7,648,214 | B2 | 1/2010 | Chen et al. | |
| 8,752,917 | B1 | 6/2014 | Chang et al. | |
| 9,279,451 | B2 | 3/2016 | Judge | |
| 2002/0081887 | A1 | 6/2002 | Judge et al. | |
| 2004/0207301 | A1* | 10/2004 | Chen | A47B 88/493 312/334.44 |
| 2021/0259414 | A1* | 8/2021 | Wu | A47B 88/423 |

FOREIGN PATENT DOCUMENTS

TW I751080 B 12/2021

OTHER PUBLICATIONS

Search Report mailed to Corresponding European Patent Application No. 23166475.6-1015 on Sep. 21, 2023.

* cited by examiner

*Primary Examiner* — Matthew W Ing
(74) *Attorney, Agent, or Firm* — Rosenberg, Klein & Lee

(57) ABSTRACT

A slide rail assembly includes a first rail, a second rail, a slide-facilitating device, and a retaining member. The second rail is movably mounted in a channel of, and is longitudinally displaceable with respect to, the first rail. The slide-facilitating device is movably mounted between the rails and includes an engaging feature. The retaining member is provided on the first rail and includes an elastic portion with a predetermined feature. The first rail includes a limiting feature for preventing deformation of the elastic portion. When the second rail is moved out of the channel after displacement in an opening direction with respect to the first rail, the slide-facilitating device is at a predetermined position, with the engaging feature engaged with the predetermined feature.

19 Claims, 17 Drawing Sheets

SLIDE RAIL ASSEMBLY

FIELD OF THE INVENTION

The present invention relates to a slide rail assembly that can be reliably used.

BACKGROUND OF THE INVENTION

U.S. Pat. No. 6,851,773B2 discloses a retaining structure for a slide-aiding member of a track device of a drawer. The track device includes a first track, a second track, a slide-aiding member, and a retaining member. The slide-aiding member is movably mounted between the first track and the second track and is provided with an engaging notch at the front end. The retaining member is provided at an opening of a channel of the first track. When the second track is moved out of the channel of the first track after being displaced in an opening direction with respect to the first track, a resilient hook rod (or more particularly a hook thereof) of the retaining member is engaged with the engaging notch of the slide-aiding member to prevent the slide-aiding member from sliding arbitrarily with respect to the first track, and this allows the second track to be reinserted into the channel of the first track stably or in a supported manner.

While the patent cited above has disclosed the technical features of the retaining structure for the slide-aiding member, different user needs make it worthwhile to develop a different slide rail product that features higher reliability in use.

SUMMARY OF THE INVENTION

The present invention provides a slide rail assembly that is reliable in use.

According to one aspect of the present invention, a slide rail assembly includes a first rail, a second rail, a slide-facilitating device, and a retaining member. The first rail includes a channel. The second rail is movably mounted in the channel of the first rail and can be longitudinally displaced with respect to the first rail. The slide-facilitating device is movably mounted between the first rail and the second rail and includes an engaging feature. The retaining member is provided on the first rail and includes an elastic portion. The elastic portion of the retaining member includes a predetermined feature. The first rail includes a limiting feature configured to prevent the elastic portion from moving in a transverse direction. When the second rail is moved out of the channel of the first rail after being displaced in an opening direction with respect to the first rail, the slide-facilitating device is at a predetermined position, and the engaging feature of the slide-facilitating device is engaged with the predetermined feature of the elastic portion of the retaining member.

Preferably, one of the predetermined feature and the limiting feature is a space, and the other of the predetermined feature and the limiting feature is a projecting portion configured to extend into the space.

Preferably, the space is a hole, and the hole is defined by a plurality of hole walls.

Preferably, the first rail includes a first wall, a second wall, and a longitudinal wall connected between the first wall and the second wall of the first rail; and the first wall, the second wall, and the longitudinal wall of the first rail jointly define the channel Preferably, the retaining member further includes a main body portion connected to the longitudinal wall of the first rail, the elastic portion has a first end section and a second end section, the first end section of the elastic portion is connected to the main body portion, and the predetermined feature is provided at the second end section of the elastic portion.

Preferably, the second end section of the elastic portion includes a first guiding feature and a second guiding feature, and the predetermined feature is provided between the first guiding feature and the second guiding feature.

Preferably, the main body portion of the retaining member has a supporting section for supporting the elastic portion.

Preferably, the predetermined feature is substantially larger in size than the engaging feature.

Preferably, the second rail includes a releasing feature, and in the course in which the second rail is reinserted into the channel of the first rail from outside the channel of the first rail in a retracting direction, the elastic portion of the retaining member is moved by the releasing feature of the second rail such that the engaging feature of the slide-facilitating device is disengaged from the predetermined feature of the elastic portion of the retaining member, thereby allowing the slide-facilitating device to be displaced from the predetermined position in the retracting direction.

Preferably, the slide-facilitating device further includes a first portion, a second portion, and a longitudinal portion connected between the first portion and the second portion; and the first portion, the second portion, and the longitudinal portion correspond to the first wall, the second wall, and the longitudinal wall of the first rail respectively. Preferably, the first portion of the slide-facilitating device is provided with a plurality of rolling balls for supporting the first wall of the first rail, and the second portion of the slide-facilitating device is provided with a plurality of rolling balls for supporting the second wall of the first rail.

Preferably, the engaging feature of the slide-facilitating device is an engaging hook.

According to another aspect of the present invention, a slide rail assembly includes a first rail, a second rail, a slide-facilitating device, and a retaining member. The first rail includes a first wall, a second wall, and a longitudinal wall connected between the first wall and the second wall of the first rail. The first wall, the second wall, and the longitudinal wall of the first rail jointly define a channel. The second rail is movably mounted in the channel of the first rail and can be longitudinally displaced with respect to the first rail. The slide-facilitating device is movably mounted between the first rail and the second rail and includes an engaging feature. The retaining member is provided on the longitudinal wall of the first rail and includes an elastic portion. The elastic portion of the retaining member includes a space, and the longitudinal wall of the first rail includes a projecting portion configured to extend into the space. When the second rail is moved out of the channel of the first rail after being displaced in an opening direction with respect to the first rail, the engaging feature of the slide-facilitating device extends into the space of the elastic portion of the retaining member to prevent the slide-facilitating device from being arbitrarily displaced with respect to the first rail.

Preferably, the space is a hole, and the hole is defined by a plurality of hole walls.

Preferably, the retaining member further includes a main body portion connected to the longitudinal wall of the first rail, the elastic portion has a first end section and a second end section, the first end section of the elastic portion is connected to the main body portion, and the space is provided at the second end section of the elastic portion.

Preferably, the second end section of the elastic portion includes a first guiding feature and a second guiding feature, and the space is provided between the first guiding feature and the second guiding feature.

Preferably, the main body portion of the retaining member has a supporting section for supporting the elastic portion.

Preferably, the space is substantially larger in size than the engaging feature.

Preferably, the second rail includes a releasing feature, and in the course in which the second rail is reinserted into the channel of the first rail from outside the channel of the first rail in a retracting direction, the elastic portion of the retaining member is moved by the releasing feature of the second rail such that the engaging feature of the slide-facilitating device is disengaged from the space of the elastic portion of the retaining member, thereby allowing the slide-facilitating device to be displaced from a predetermined position in the retracting direction.

Preferably, the slide-facilitating device further includes a first portion, a second portion, and a longitudinal portion connected between the first portion and the second portion; and the first portion, the second portion, and the longitudinal portion correspond to the first wall, the second wall, and the longitudinal wall of the first rail respectively. Preferably, the first portion of the slide-facilitating device is provided with a plurality of rolling balls for supporting the first wall of the first rail, and the second portion of the slide-facilitating device is provided with a plurality of rolling balls for supporting the second wall of the first rail.

Preferably, the engaging feature of the slide-facilitating device is an engaging hook.

Preferably, the elastic portion of the retaining member is provided with an extension section adjacent to the space, and the engaging feature of the slide-facilitating device corresponds to the extension section when extending into the space of the elastic portion of the retaining member.

DETAILED DESCRIPTION OF THE INVENTION

Figure 1:
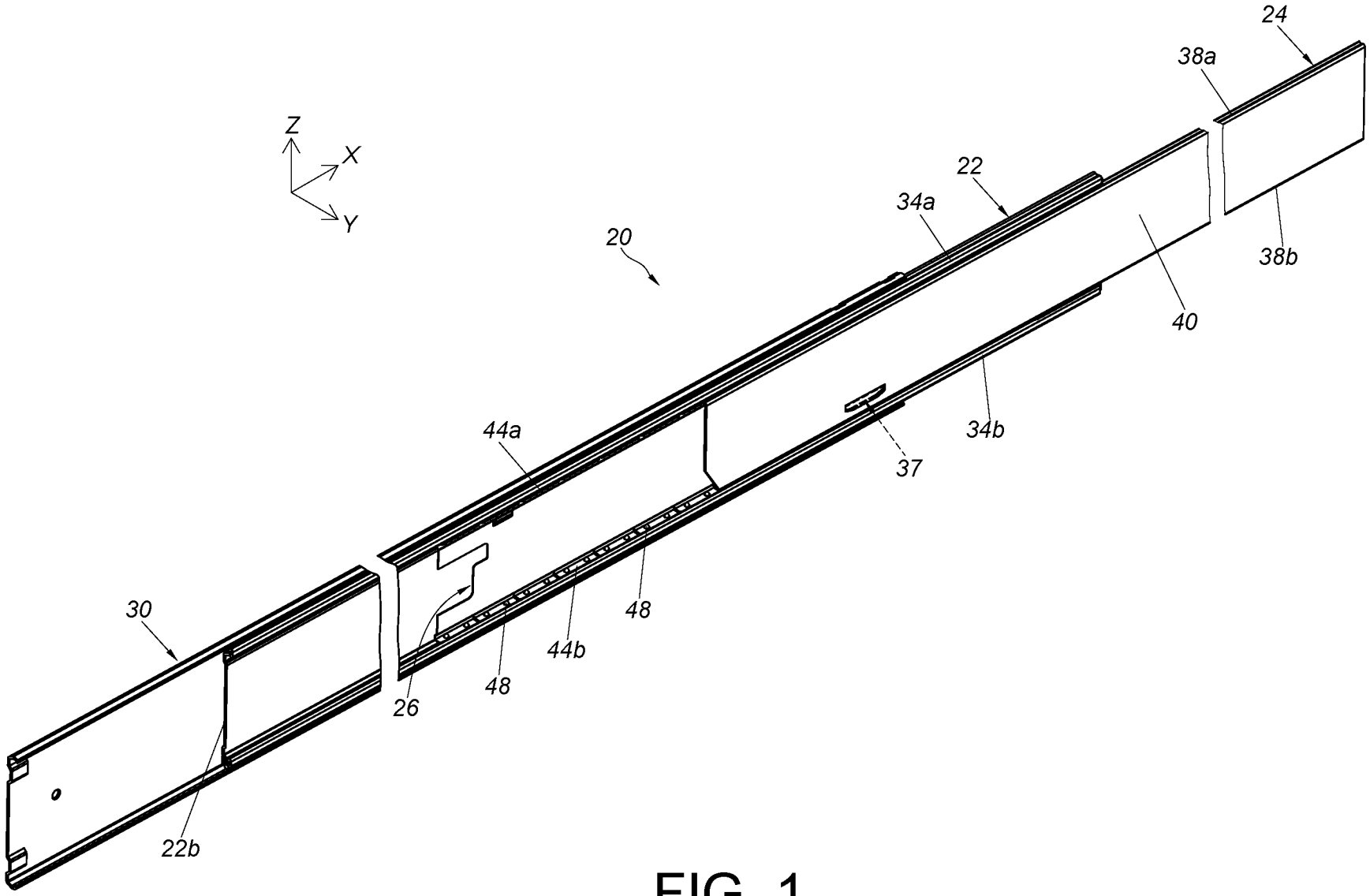
FIG. 1 is an assembled perspective view of the slide rail assembly according to an embodiment of the present invention.
Figures 2, 2A:
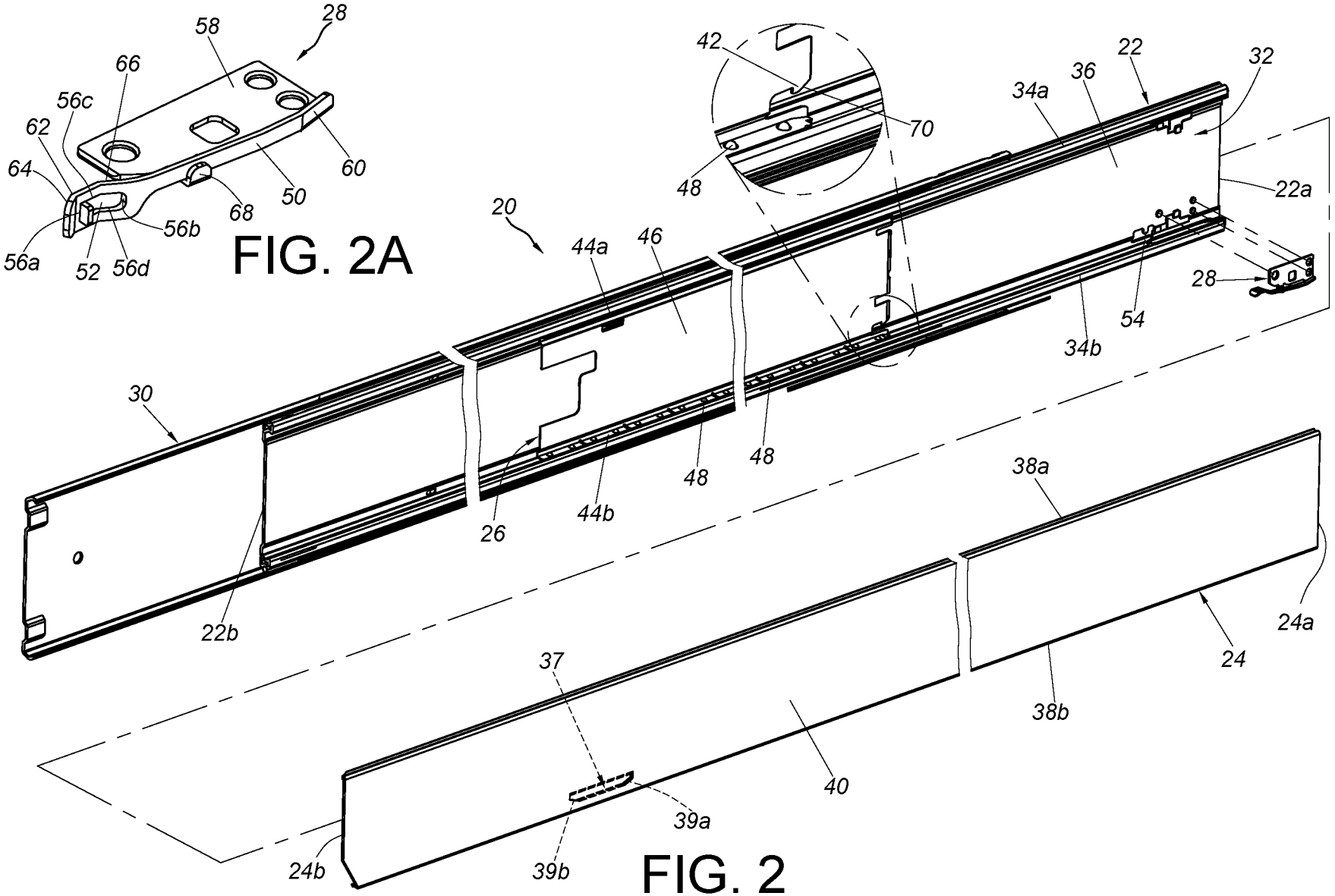
FIG. 2 is an exploded perspective view of the slide rail assembly according to the embodiment of the present invention.
FIG. 2A is a perspective view of the retaining member of the slide rail assembly according to the embodiment of the present invention.

Referring to FIG. 1 and FIG. 2, the slide rail assembly 20 according to an embodiment of the present invention includes a first rail 22, a second rail 24, a slide-facilitating device 26, a retaining member 28, and preferably also a third rail 30. The first rail 22 is movably mounted between the third rail 30 and the second rail 24, and the first rail 22 serves to increase the distance for which the second rail 24 can be displaced with respect to the third rail 30. In this embodiment, the third rail 30 (e.g., an outer rail), the first rail 22 (e.g., a middle rail), and the second rail 24 (e.g., an inner rail) can be longitudinally displaced with respect to one another. Herein, the longitudinal direction (or the length direction of the slide rails) is defined by the X axis in FIG. 1, the transverse direction (or the lateral direction of the slide rails) by the Y axis, and the vertical direction (or the height direction of the slide rails) by the Z axis.

The first rail 22 includes a channel 32. Preferably, the first rail 22 includes a first wall 34*a*, a second wall 34*b*, and a longitudinal wall 36 connected between the first wall 34*a* and the second wall 34*b* of the first rail 22. The first wall 34*a*, the second wall 34*b*, and the longitudinal wall 36 of the first rail 22 jointly define the channel 32. The first rail 22 has a front end 22*a* and a rear end 22*b*.

The second rail 24 is movably mounted in the channel 32 of the first rail 22, and the second rail 24 can be longitudinally displaced with respect to the first rail 22. The second rail 24 includes a first wall 38*a*, a second wall 38*b*, and a longitudinal wall 40 connected between the first wall 38*a* and the second wall 38*b* of the second rail 24. The second rail 24 includes a releasing feature 37 such as a projection, and the releasing feature 37 includes a first guiding structure 39*a* and a second guiding structure 39*b*. Each of the first guiding structure 39*a* and the second guiding structure 39*b* may be an inclined surface or a curved surface; the present invention has no limitation in this regard. The second rail 24 has a front end 24*a* and a rear end 24*b*, and the releasing feature 37 is adjacent to the rear end 24*b* of the second rail 24.

The slide-facilitating device 26 is movably mounted between the first rail 22 and the second rail 24, and the slide-facilitating device 26 includes an engaging feature 42 such as an engaging hook. Preferably, the slide-facilitating device 26 further includes a first portion 44*a*, a second portion 44*b*, and a longitudinal portion 46 connected between the first portion 44*a* and the second portion 44*b*. The first portion 44*a*, the second portion 44*b*, and the longitudinal portion 46 correspond to the first wall 34*a*, the second wall 34*b*, and the longitudinal wall 36 of the first rail 22 respectively. Each of the first portion 44*a* and the second portion 44*b* of the slide-facilitating device 26 is provided with a plurality of rolling balls 48 (only the rolling balls 48 on the second portion 44*b* being visible in FIG. 1 and FIG. 2 due to limitations of the viewing angle). The rolling balls 48 on the first portion 44*a* are used to support the first wall 34*a* of the first rail 22 and the first wall 38*a* of the second rail 24, and the rolling balls 48 on the second portion 44*b* are used to support the second wall 34*b* of the first rail 22 and the second wall 38*b* of the second rail 24. The rolling balls 48 help increase the smoothness with which the second rail 24 and the first rail 22 can be displaced with respect to each other.

The retaining member 28 is provided on the longitudinal wall 36 of the first rail 22, and the retaining member 28 is adjacent to the front end 22*a* of the first rail 22. The distance between the releasing feature 37 and the rear end 24*b* of the second rail 24 is greater (or slightly greater) than the distance between the retaining member 28 and the front end 22*a* of the first rail 22. The retaining member 28 includes an elastic portion 50 (see FIG. 2, FIG. 2A, FIG. 3, and FIG. 4), such as but not limited to an elastic arm. The elastic portion 50 of the retaining member 28 includes a predetermined feature 52, and the longitudinal wall 36 of the first rail 22 includes a limiting feature 54.

Figure 3:
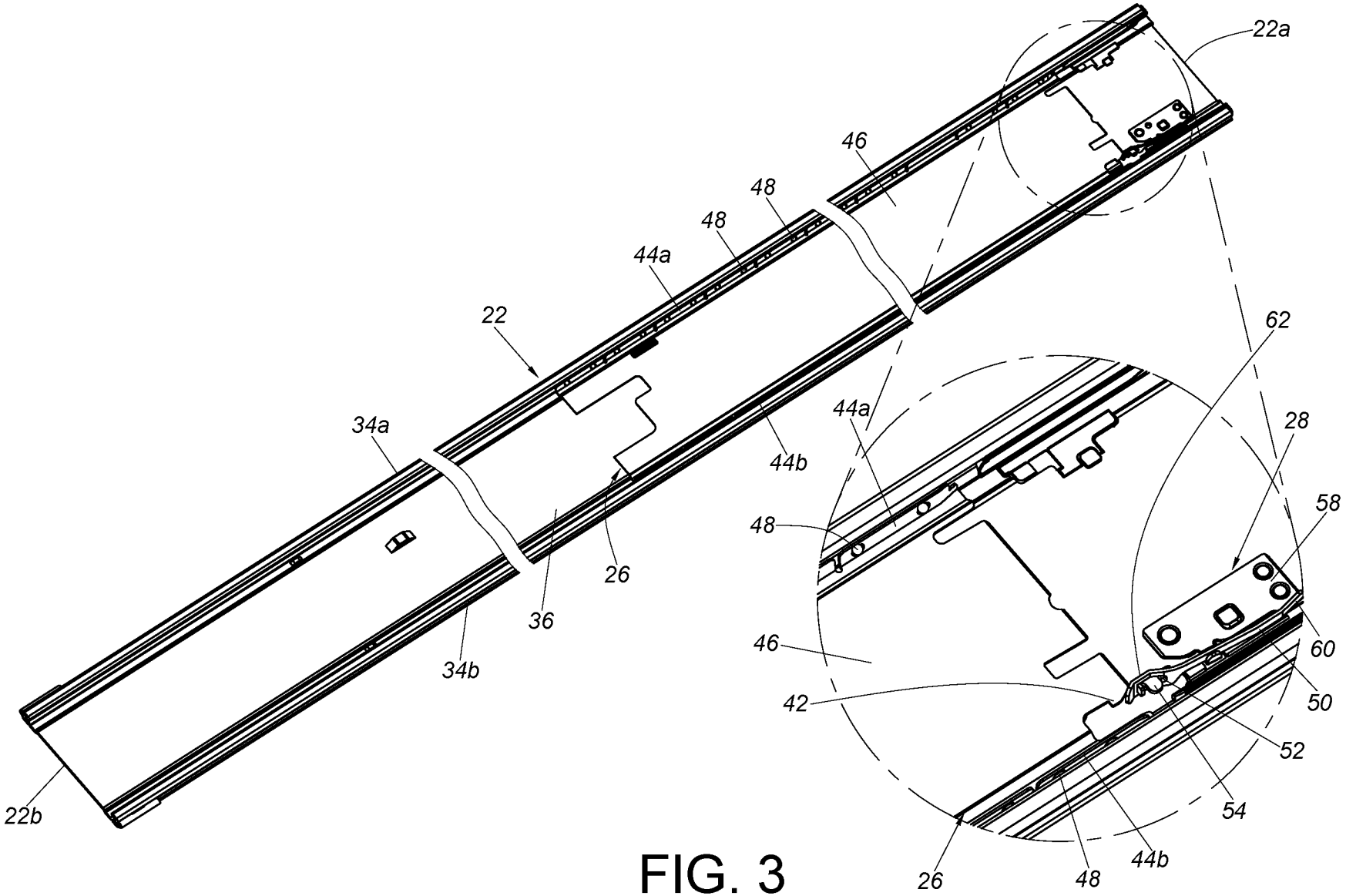
FIG. 3 is a perspective view of the first rail of the slide rail assembly according to the embodiment of the present invention.
Figure 4:
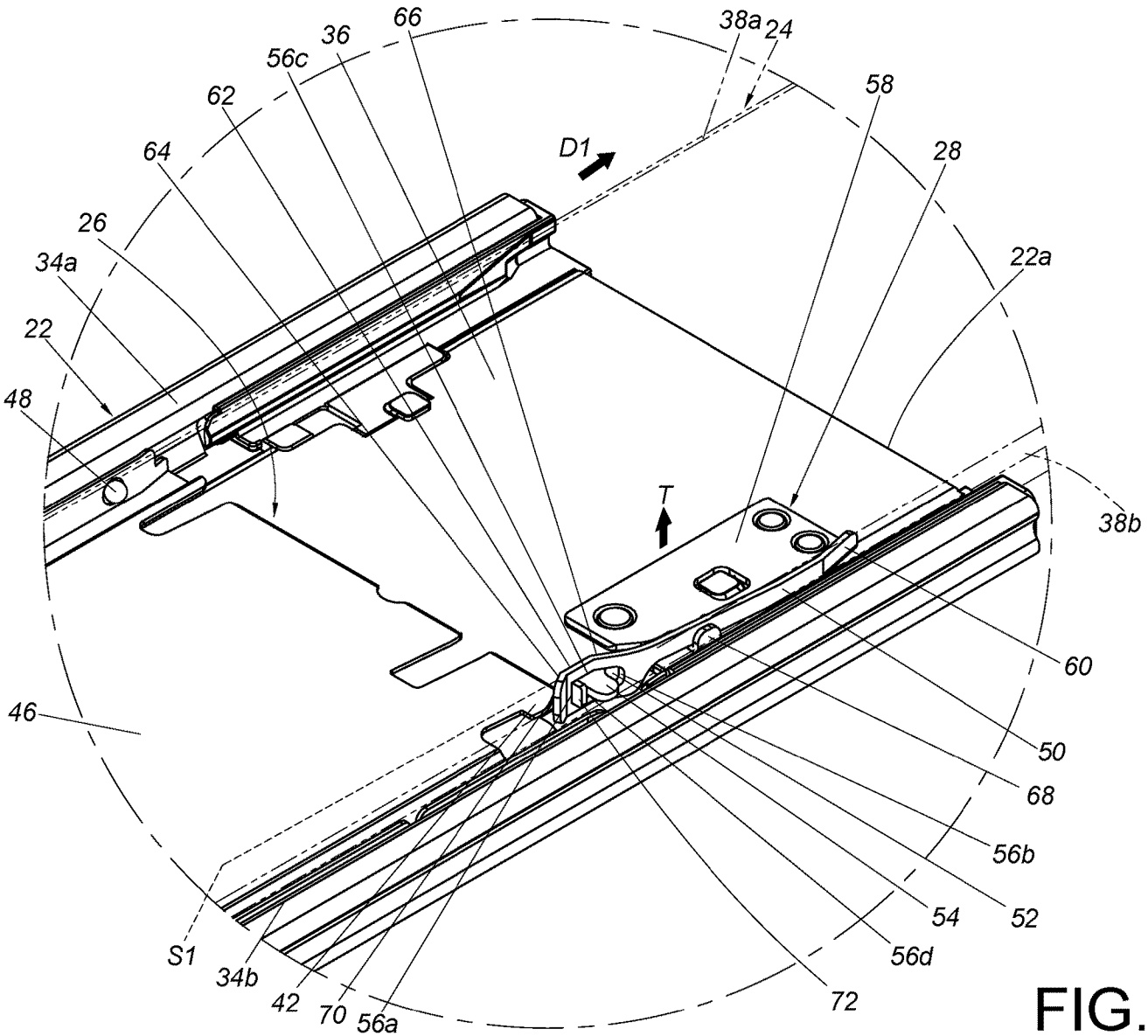
FIG. 4 is a schematic view showing that the second rail of the slide rail assembly according to the embodiment of the present invention is displaced in an opening direction with respect to the first rail.

Preferably, one of the predetermined feature 52 and the limiting feature 54 is a space, and the other of the predetermined feature 52 and the limiting feature 54 is a projecting portion configured to extend into the space (see FIG. 3 and FIG. 4). Here, by way of example only, the predetermined feature 52 is a space, and the limiting feature 54 is a projecting portion extending into the space. Preferably, the space is a hole, and the hole is defined by a plurality of hole walls. For example, the elastic portion 50 includes a first hole wall 56*a*, a second hole wall 56*b*, a third hole wall 56*c*, and a fourth hole wall 56*d*, and the hole walls 56*a*, 56*b*, 56*c*, and 56*d* jointly define a contour of a predetermined shape.

Preferably, the retaining member 28 further includes a main body portion 58 connected (e.g., fixedly connected) to the longitudinal wall 36 of the first rail 22, and the elastic portion 50 has a first end section 60 and a second end section 62. The first end section 60 of the elastic portion 50 is connected to the main body portion 58. The second end section 62 extends from the first end section 60 and can be moved with respect to the first end section 60 in an elastic manner. The predetermined feature 52 is provided at the second end section 62 of the elastic portion 50.

Preferably, the second end section 62 of the elastic portion 50 includes a first guiding feature 64 and a second guiding feature 66, and the predetermined feature 52 is provided between the first guiding feature 64 and the second guiding feature 66. Each of the first guiding feature 64 and the second guiding feature 66 may be an inclined surface or a curved surface.

Preferably, the main body portion 58 of the retaining member 28 has a supporting section 68, and the supporting section 68 is configured to support the elastic portion 50. Here, by way of example, the supporting section 68 is bent with respect to the main body portion 58 and supports a bottom portion of the elastic portion 50. By supporting the elastic portion 50, the supporting section 68 contributes to the stability of movement of the elastic portion 50. The main body portion 58, the elastic portion 50, and the supporting section 68 may be integrated into one unit in order for the retaining member 28 to be a single component (see FIG. 2A).

Referring to FIG. 4, the engaging feature 42 of the slide-facilitating device 26 is located at the longitudinal portion 46 and has a guiding section 70, which may be an inclined surface or a curved surface. The elastic portion 50 of the retaining member 28 is shown in FIG. 4 as in a first state S1. In addition, the elastic portion 50 of the retaining member 28 is provided with an extension section 72 adjacent to the predetermined feature 52. For example, the extension section 72 extends from the first hole wall 56*a* toward the second wall 34*b* of the first rail 22.

Figure 4A:
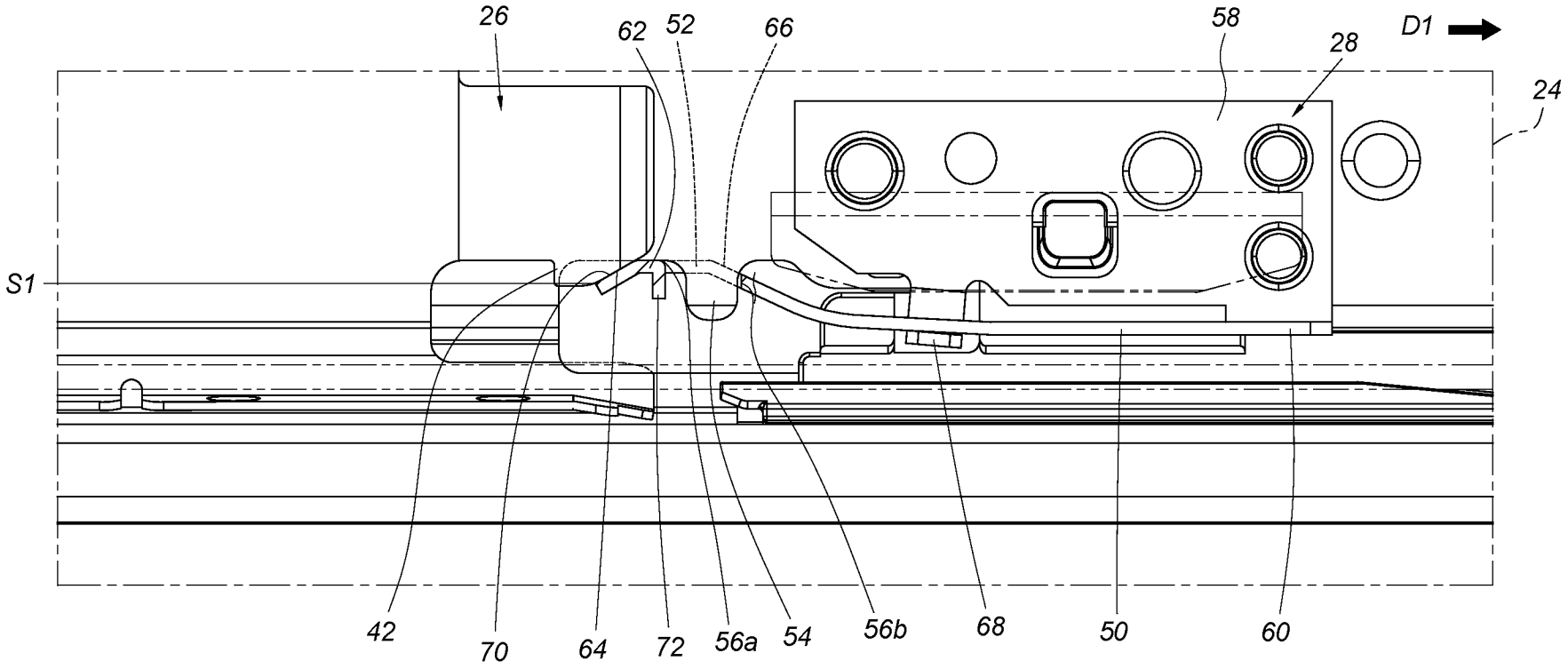
FIG. 4A is another schematic view showing that the second rail of the slide rail assembly according to the embodiment of the present invention is displaced in the opening direction with respect to the first rail.

When the second rail 24 reaches a predetermined position after being displaced from a retracted position with respect to the first rail 22 in an opening direction D1, the first guiding structure 39*a* of the releasing feature 37 contacts the first guiding feature 64 so that the releasing feature 37 can move past the elastic portion 50 with ease, and the slide-facilitating device 26 will respond to the displacement of the second rail 24 by moving in the opening direction D1 too, during which process the engaging feature 42 (or more particularly the guiding section 70 thereof) of the slide-facilitating device 26 contacts the first guiding feature 64 of the elastic portion 50 of the retaining member 28 (see FIG. 4 and FIG. 4A). The foregoing movements can be readily understood by a person of ordinary skill in the art and therefore will not be described in more detail.

It is worth mentioning that if the second rail 24 is displaced so fast in the opening direction D1 that the instantaneous force with which the releasing feature 37 (or more particularly the first guiding structure 39*a* thereof) or the engaging feature 42 (or more particularly the guiding section 70 thereof) of the slide-facilitating device 26 contacts the second end section 62 (or more particularly the first guiding feature 64 thereof) of the elastic portion 50 is too great, the limiting feature 54 can prevent the second end section 62 of the elastic portion 50 from deformation or warping in a specific direction or at a specific angle. With the extension section 72 increasing the area of the first hole wall 56*a* that corresponds to the limiting feature 54, the limiting feature 54 can effectively prevent the second end section 62 (or more particularly the first guiding feature 64 thereof) of the elastic portion 50 from deformation by the force applied to displace the second rail 24. Or, the limiting feature 54 can block the fourth hole wall 56*d* and thereby prevent the second end section 62 of the elastic portion 50 from being moved or deformed in a transverse direction T (e.g., the Y-axis direction in FIG. 1, or the lateral direction of the first rail 22 as shown in FIG. 4).

Figure 5:
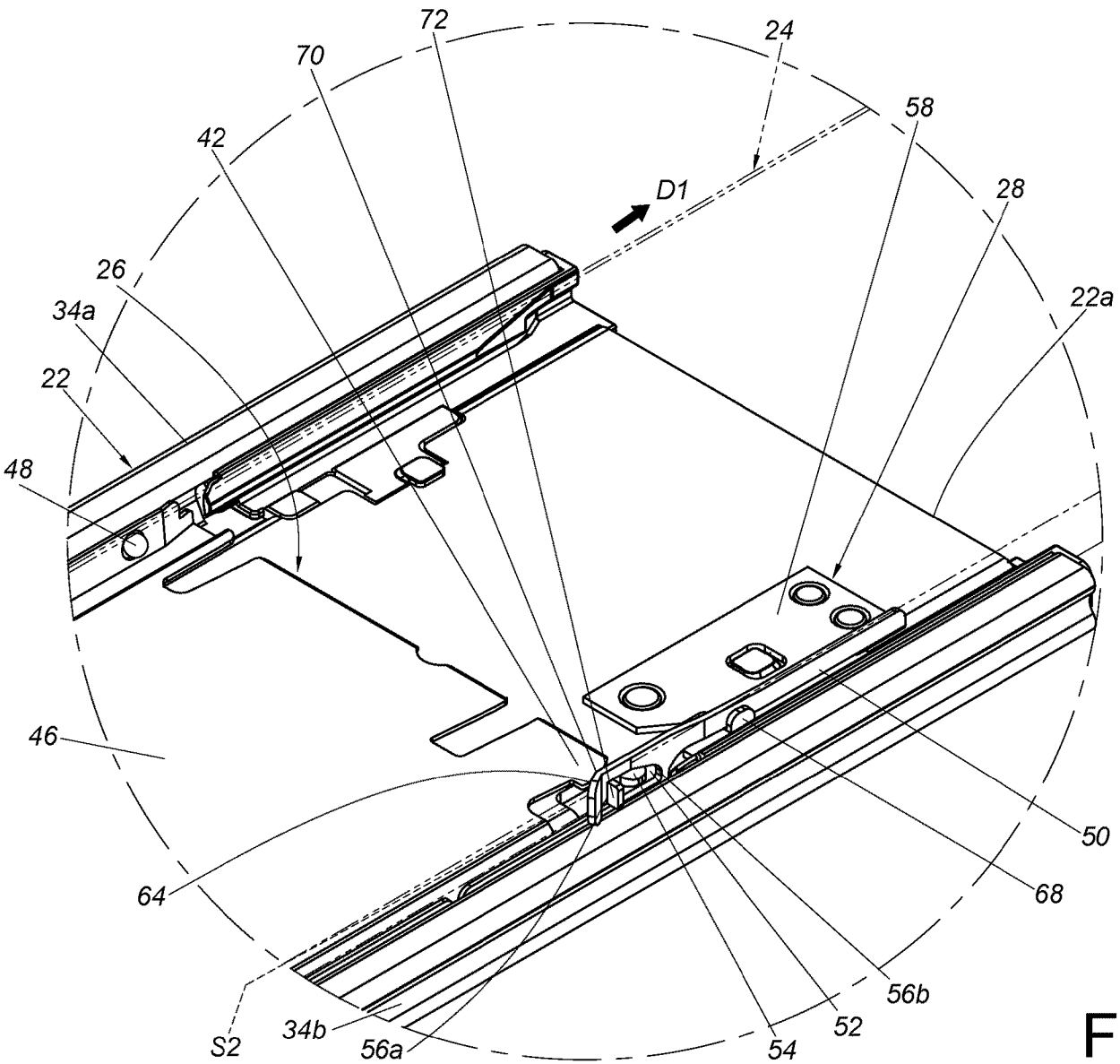
FIG. 5 is a schematic view showing that the second rail of the slide rail assembly according to the embodiment of the present invention is further displaced in the opening direction with respect to the first rail.
Figure 5A:
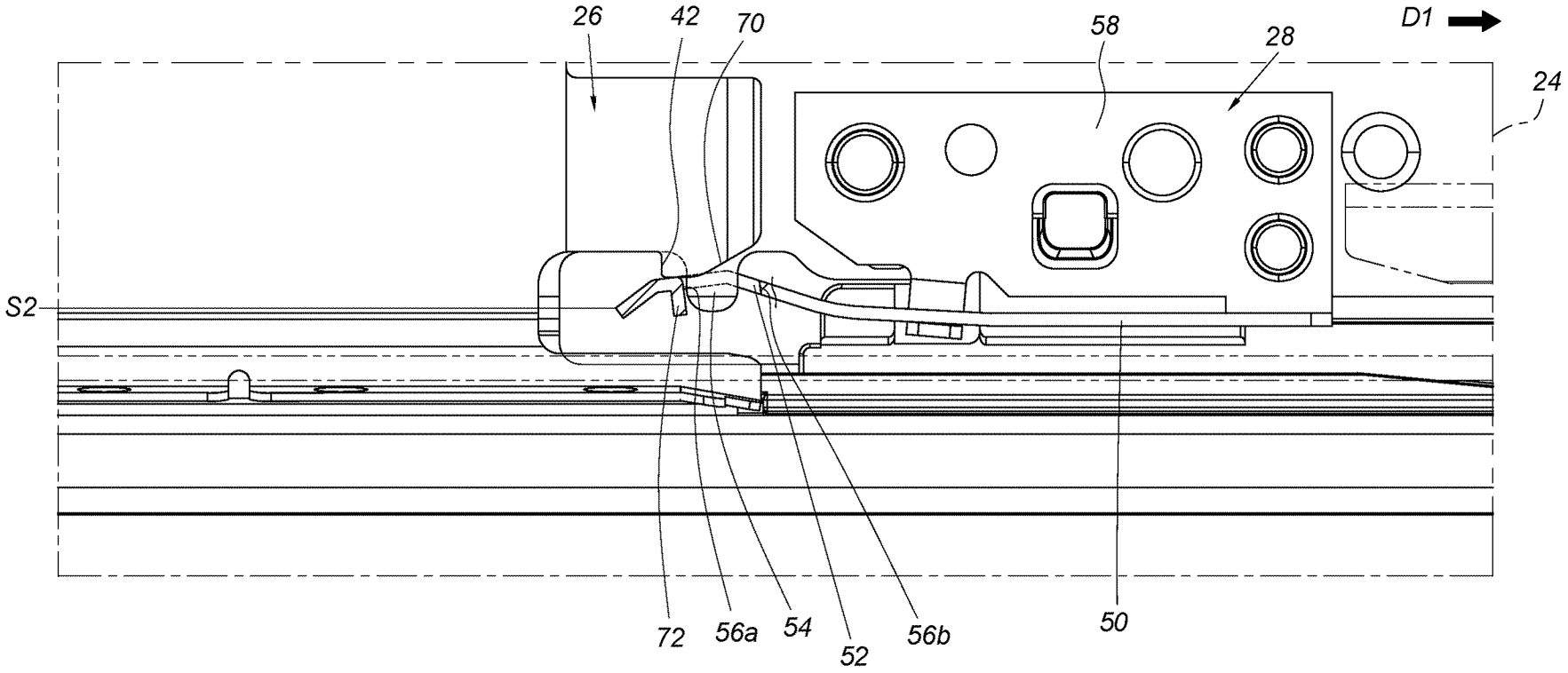
FIG. 5A is another schematic view showing that the second rail of the slide rail assembly according to the embodiment of the present invention is further displaced in the opening direction with respect to the first rail.

Referring to FIG. 5 and FIG. 5A, when the second rail 24 is further displaced in the opening direction D1 with respect to the first rail 22, the contact between the engaging feature 42 (or more particularly the guiding section 70 thereof) of the slide-facilitating device 26 and the first guiding feature 64 of the elastic portion 50 of the retaining member 28 produces an action force that moves the elastic portion 50 of the retaining member 28 from the first state S1 to a second state S2, where the elastic portion 50 stores an elastic force.

Figure 6:
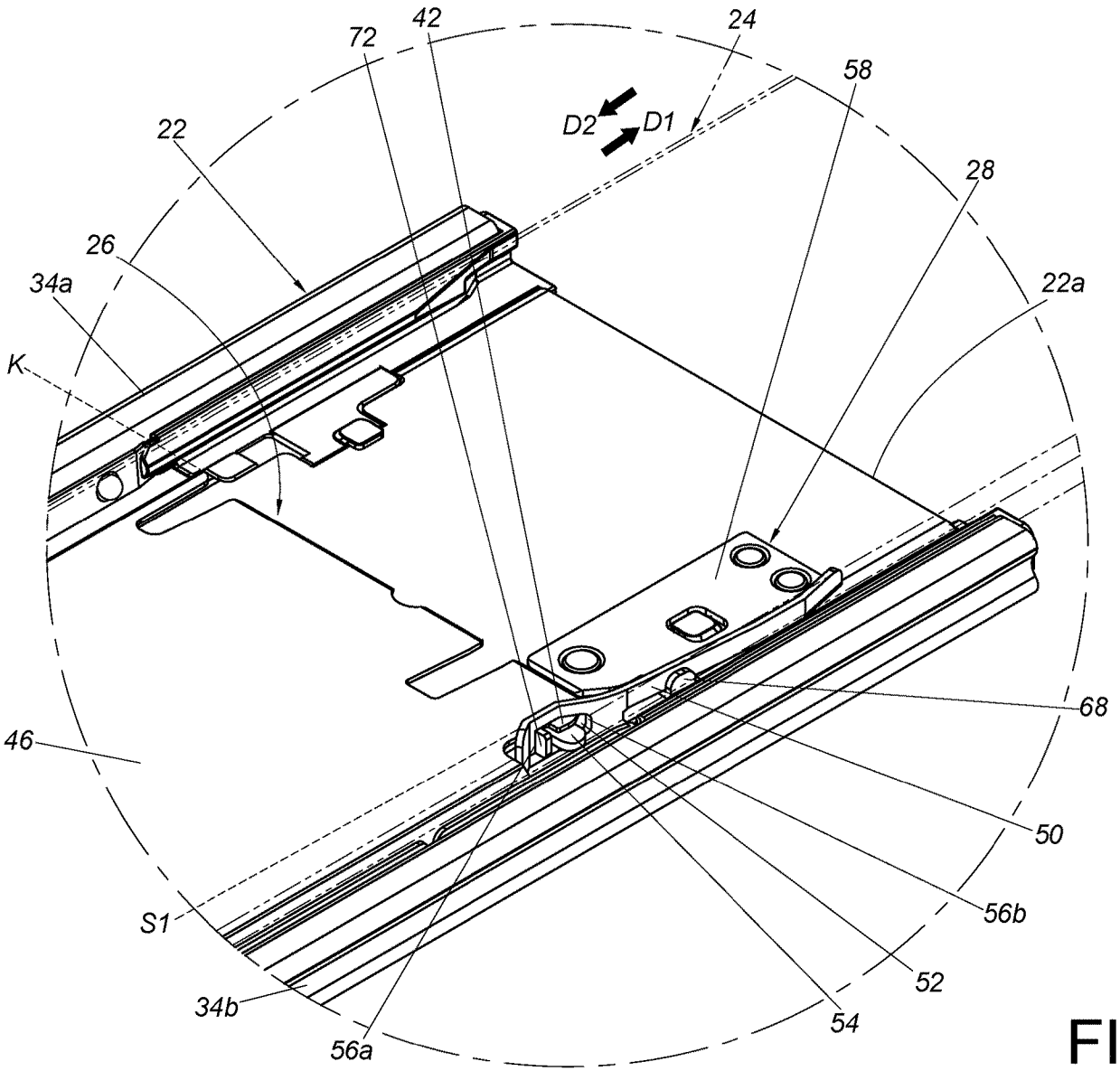
FIG. 6 is a schematic view showing that the second rail of the slide rail assembly according to the embodiment of the present invention is yet further displaced in the opening direction with respect to the first rail.
Figure 6A:
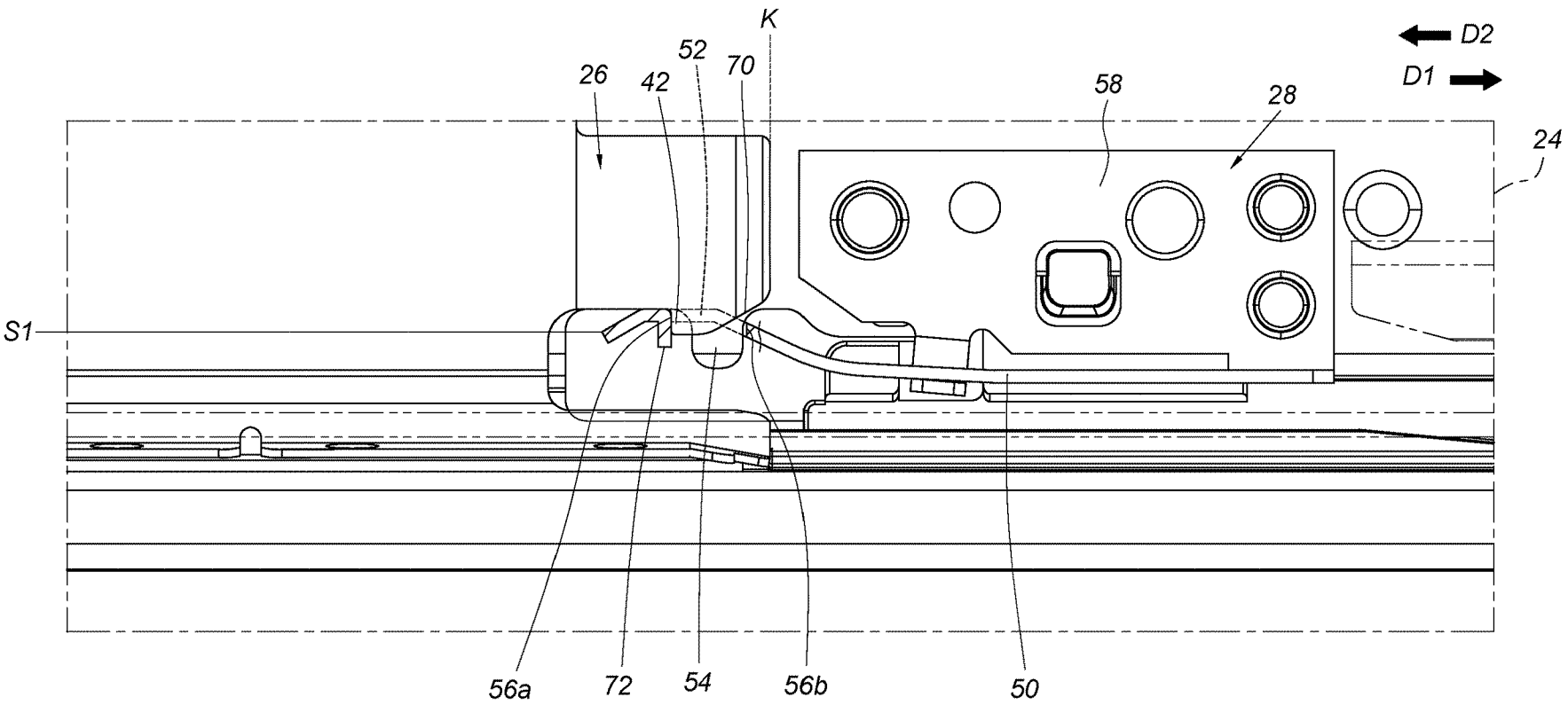
FIG. 6A is another schematic view showing that the second rail of the slide rail assembly according to the embodiment of the present invention is yet further displaced in the opening direction with respect to the first rail.
Figure 7:
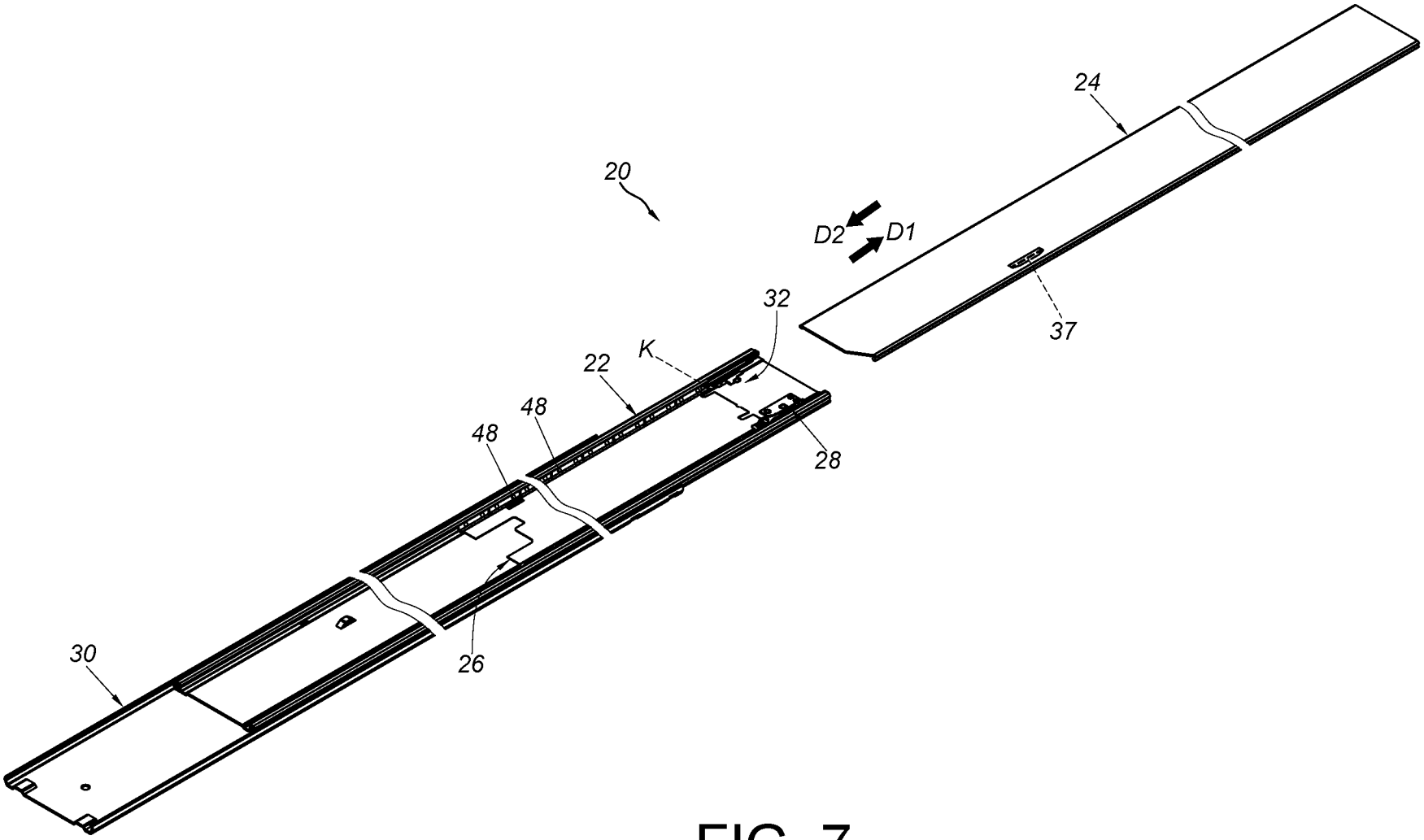
FIG. 7 shows that the first rail of the slide rail assembly according to the embodiment of the present invention is at an extended position with respect to the third rail, and that the second rail is detached from the first rail in the opening direction.

Referring to FIG. 6, FIG. 6A, and FIG. 7, when the second rail 24 is moved out of the channel 32 of the first rail 22 (see FIG. 7) after being further displaced in the opening direction D1 with respect to the first rail 22, the slide-facilitating device 26 is displaced to a predetermined position K adjacent to the front end 22*a* of the first rail 22, with the engaging feature 42 of the slide-facilitating device 26 engaged with the predetermined feature 52 of the elastic portion 50 of the retaining member 28 (see FIG. 6 and FIG. 6A).

More specifically, when the slide-facilitating device 26 reaches the predetermined position K, the engaging feature 42 of the slide-facilitating device 26 corresponds to the predetermined feature 52 of the elastic portion 50 such that the elastic portion 50 releases the elastic force stored therein and returns from the second state S2 to the first state S1 (e.g., a locking state), with the engaging feature 42 of the slide-facilitating device 26 extending into the predetermined feature 52 of the elastic portion 50 of the retaining member 28 and corresponding to the first hole wall 56*a* to prevent the slide-facilitating device 26 from arbitrary displacement with respect to the first rail 22. For example, the first hole wall 56*a* (together with the extension section 72) can block the engaging feature 42 and thereby prevent the slide-facilitating device 26 from being displaced from the predetermined position K in a retracting direction D2 with respect to the first rail 22 (see FIG. 6). When the slide-facilitating device 26 is at the predetermined position K, and the engaging feature 42 is engaged with the predetermined feature 52 of the elastic portion 50 of the retaining member 28, the engaging feature 42 and the limiting feature 54 are transversely (or laterally) offset from, and do not interfere with, each other.

Figure 8:
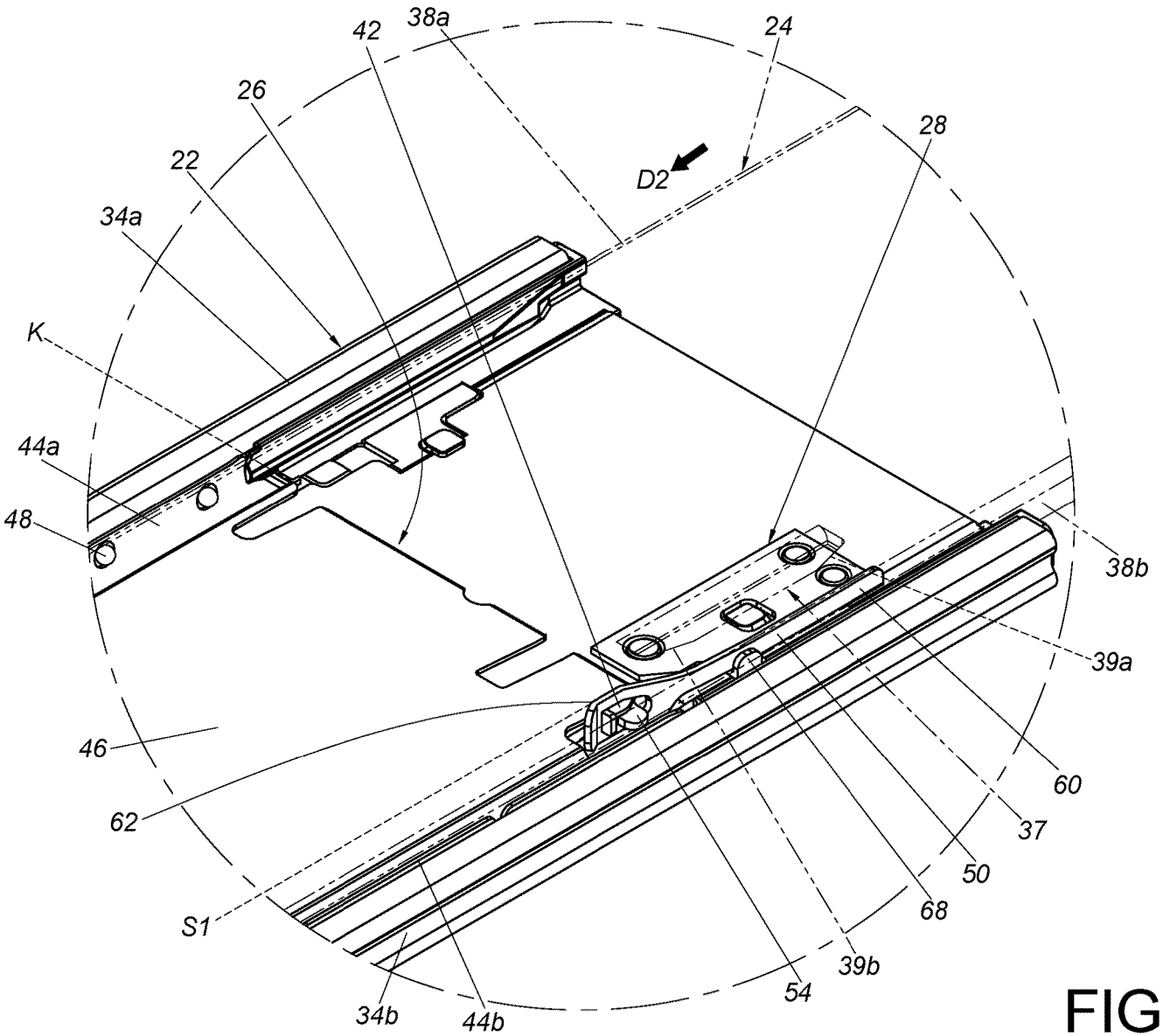
FIG. 8 is a schematic view showing that the second rail of the slide rail assembly according to the embodiment of the present invention is reinserted into the channel of the first rail in a retracting direction.

In FIG. 8, the slide-facilitating device 26 is at the predetermined position K, and the elastic portion 50 of the retaining member 28 is in the first state S1 (e.g., the locking state) to lock the engaging feature 42 of the slide-facilitating device 26 in place. When the second rail 24 is reinserted into the channel 32 of the first rail 22 from outside the channel 32 of the first rail 22 in the retracting direction D2, the first wall 38*a* and the second wall 38*b* of the second rail 24 can, at the beginning of the insertion process, be supported respectively by the rolling balls 48 on the first and the second portions 44*a* and 44*b* of the slide-facilitating device 26 because the distance between the releasing feature 37 and the rear end 24*b* of the second rail 24 is greater (or slightly greater) than the distance between the retaining member 28 and the front end 22*a* of the first rail 22, and this allows the second rail 24 to be inserted stably or smoothly into the channel 32 of the first rail 22 in the retracting direction D2.

In the course in which the second rail 24 continues being inserted into the channel 32 of the first rail 22 in the retracting direction D2, referring to FIG. 9, FIG. 9A, FIG. 10, FIG. 10A, FIG. 11, and FIG. 11A, the releasing feature 37 of the second rail 24 moves the elastic portion 50 of the retaining member 28 and thereby disengages the engaging feature 42 of the slide-facilitating device 26 from the predetermined feature 52 of the elastic portion 50 of the retaining member 28; in consequence, the slide-facilitating device 26 is allowed to be displaced from the predetermined position K in the retracting direction D2.

Figure 9:
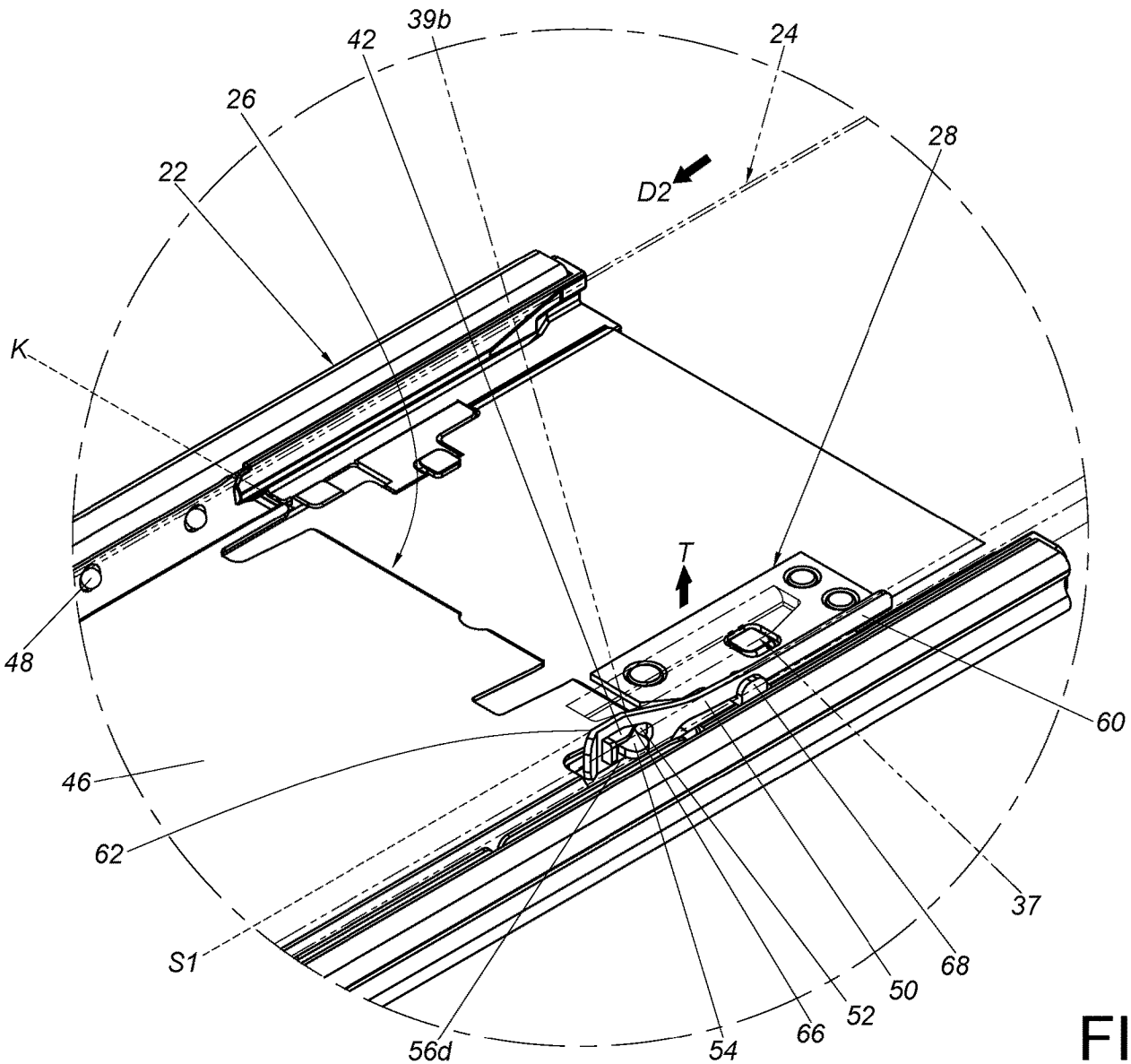
FIG. 9 is a schematic view showing that the second rail of the slide rail assembly according to the embodiment of the present invention is further displaced in the retracting direction with respect to the first rail.
Figure 9A:
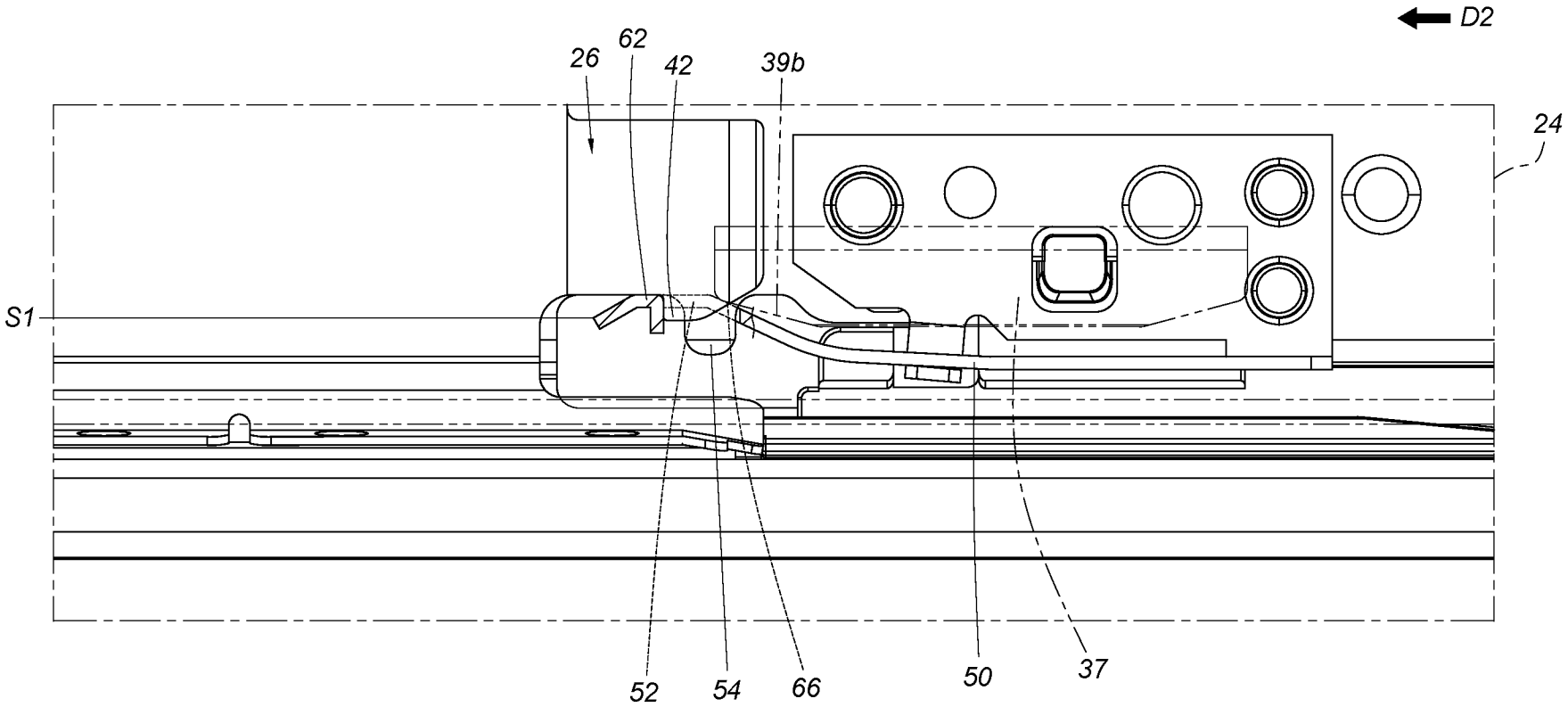
FIG. 9A is another schematic view showing that the second rail of the slide rail assembly according to the embodiment of the present invention is further displaced in the retracting direction with respect to the first rail.
Figure 10:
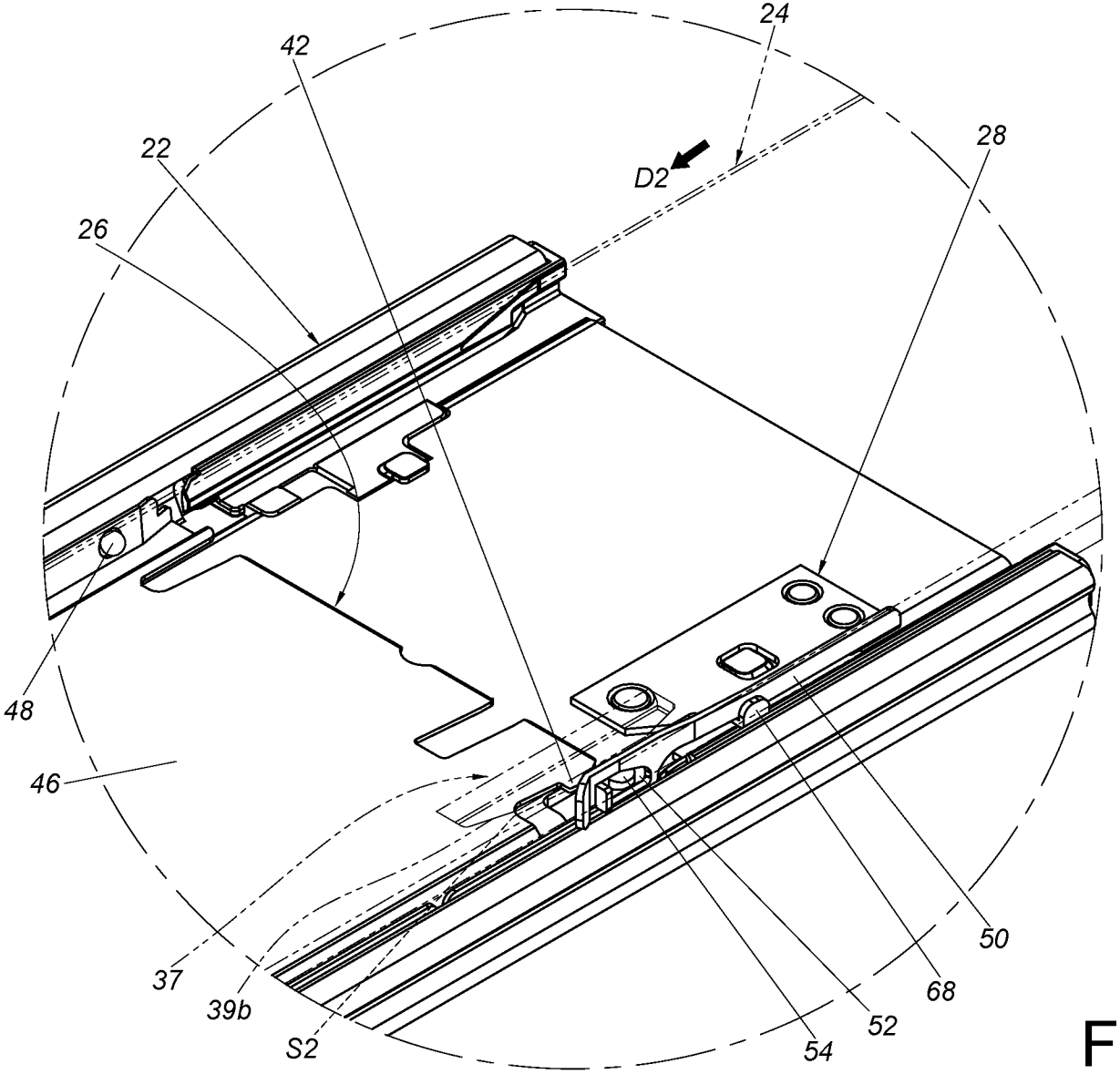
FIG. 10 is a schematic view showing that the second rail of the slide rail assembly according to the embodiment of the present invention is yet further displaced in the retracting direction with respect to the first rail.
Figure 10A:
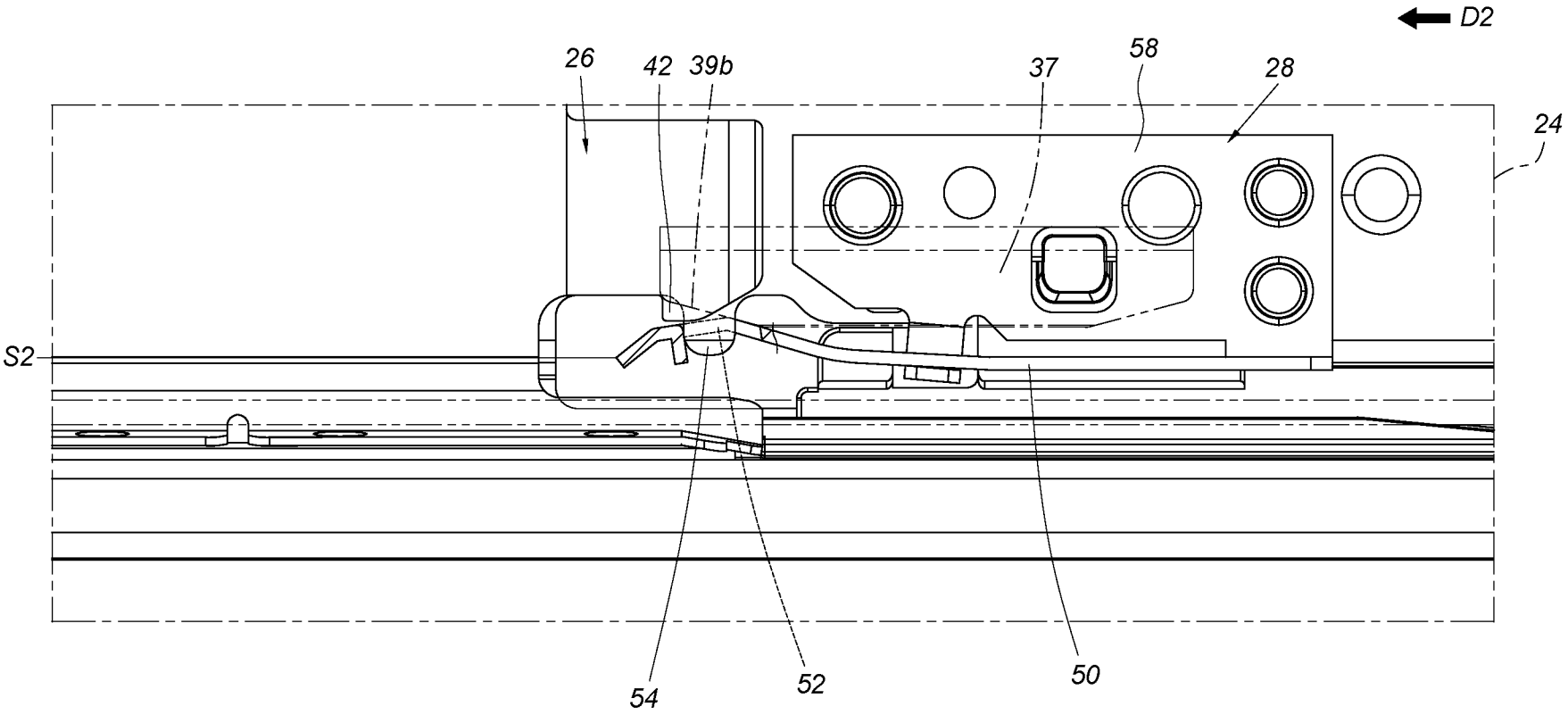
FIG. 10A is another schematic view showing that the second rail of the slide rail assembly according to the embodiment of the present invention is yet further displaced in the retracting direction with respect to the first rail.
Figure 11:
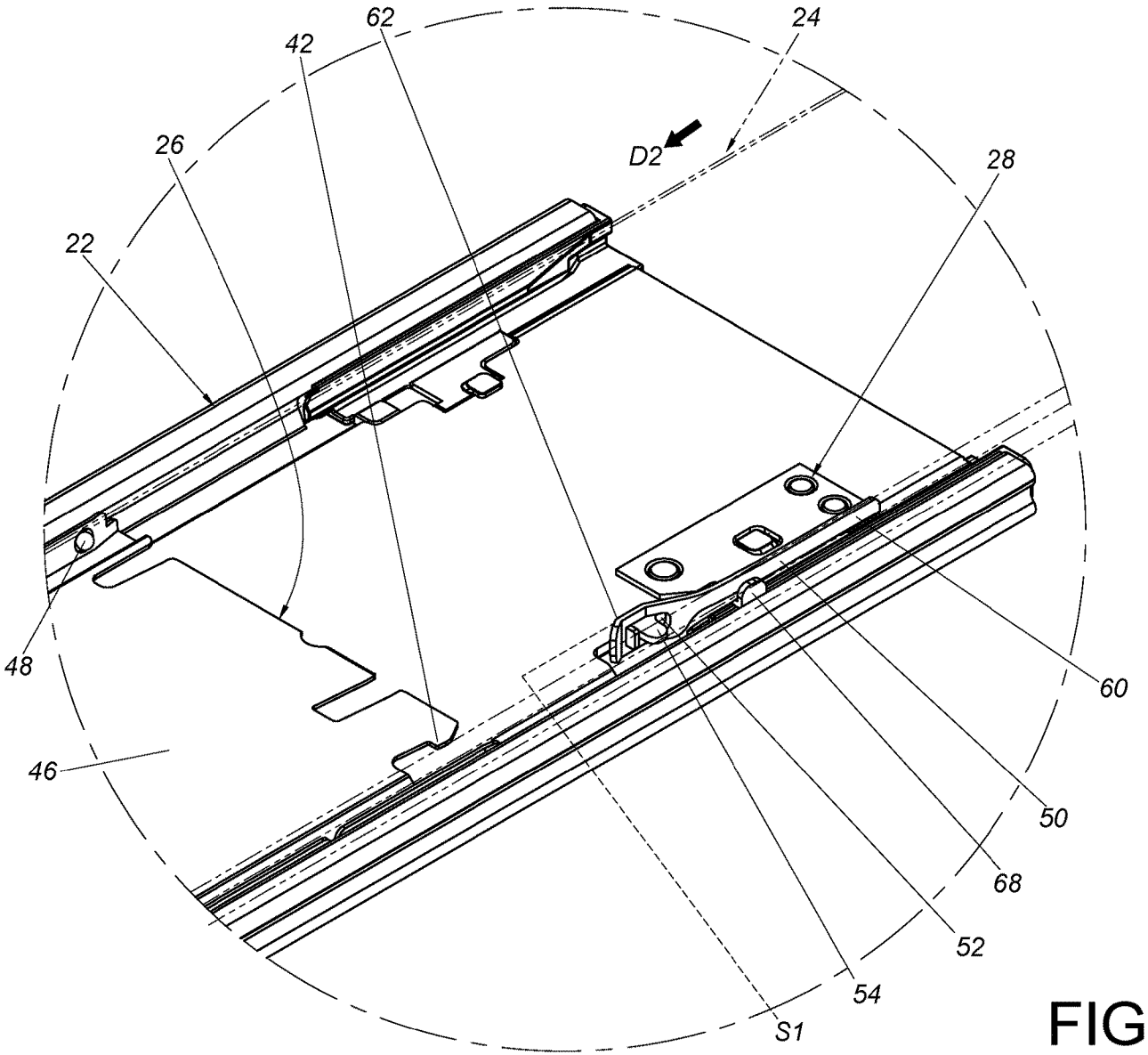
FIG. 11 is a schematic view showing that the second rail of the slide rail assembly according to the embodiment of the present invention is still further displaced in the retracting direction with respect to the first rail.
Figure 11A:
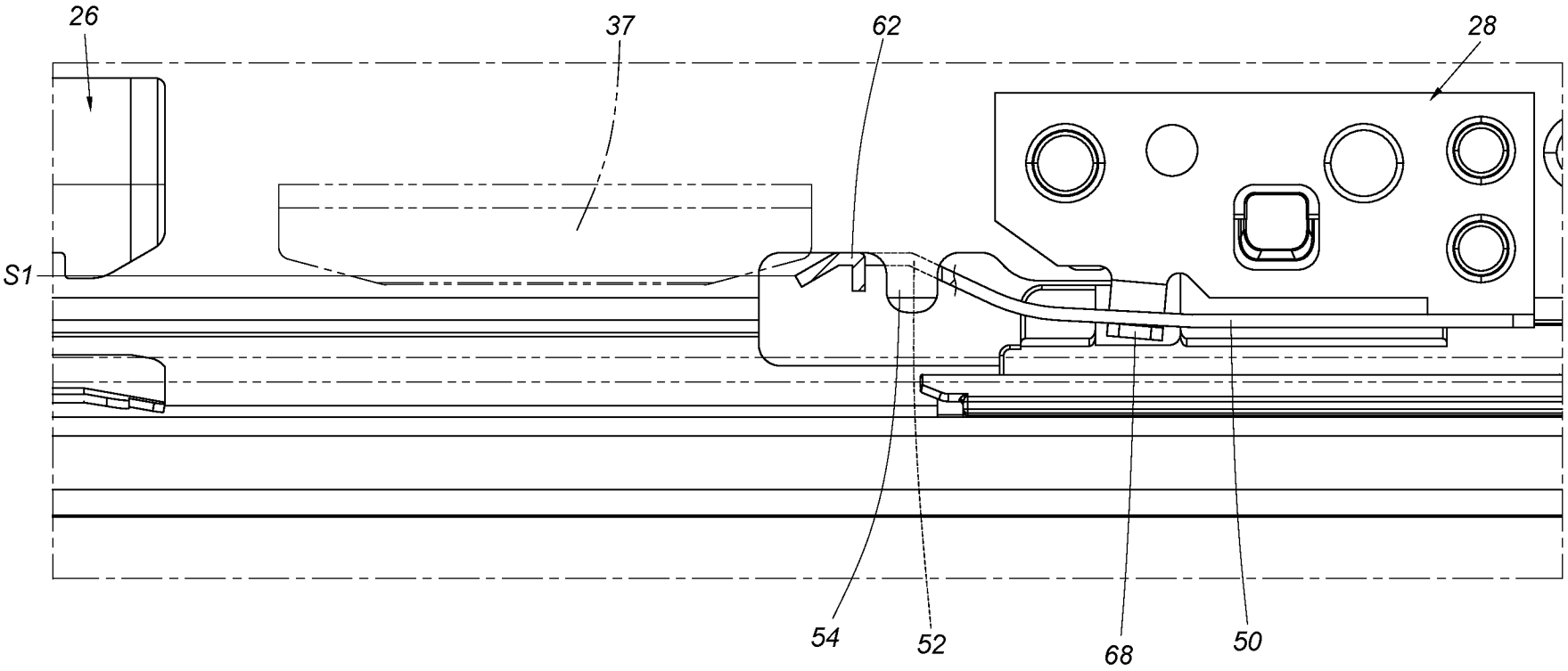
FIG. 11A another schematic view showing that the second rail of the slide rail assembly according to the embodiment of the present invention is still further displaced in the retracting direction with respect to the first rail.

More specifically, while the second rail 24 continues being inserted into the channel 32 of the first rail 22 in the retracting direction D2, the releasing feature 37 (or more particularly the second guiding structure 39*b* thereof) of the second rail 24 contacts the elastic portion 50 (or more particularly the second guiding feature 66 thereof) of the retaining member 28 and thereby produces an action force that moves the elastic portion 50 of the retaining member 28 from the first state S1 (e.g., the locking state as shown in FIG. 9 and FIG. 9A) to the second state S2 (e.g., an unlocking state as shown in FIG. 10 and FIG. 10A). As a result, the engaging feature 42 of the slide-facilitating device 26 is disengaged from the predetermined feature 52 of the elastic portion 50 of the retaining member 28, and the elastic portion 50 stores an elastic force. When the second rail 24 is further displaced in the retracting direction D2 with respect to the first rail 22, the slide-facilitating device 26 responds to the displacement of the second rail 24 by moving from the predetermined position K in the retracting direction D2, and the elastic portion 50 of the retaining member 28 releases the elastic force stored therein and returns from the second state S2 (see FIG. 10 and FIG. 10A) to the first state S1 (see FIG. 11 and FIG. 11A).

It is worth mentioning that, referring to FIG. 9 and FIG. 9A, the predetermined feature 52 is substantially larger in size than the engaging feature 42. More specifically, the longitudinal dimension of the predetermined feature 52 (e.g., a hole) is substantially greater (or slightly greater) than the longitudinal dimension of the engaging feature 42 (e.g., an engaging hook) so that the engaging feature 42 can be received in the predetermined feature 52 with a predetermined degree of looseness. The predetermined degree of looseness allows the engaging feature 42 of the slide-facilitating device 26 to be easily disengaged from the predetermined feature 52 of the elastic portion 50 of the retaining member 28 when the elastic portion 50 of the retaining member 28 is moved from the first state S1 to the second state S2 by the releasing feature 37 (or more particularly the second guiding structure 39*b* thereof) of the second rail 24 in response to the insertion of the second rail 24 into the channel 32 of the first rail 22 in the retracting direction D2. If the engaging feature 42 and the predetermined feature 52 are so sized that they may engage with each other too tightly to allow easy disengagement or may disengage from each other because of excessive tightness of engagement, the engaging feature 42 and the second end section 62 of the elastic portion 50 may be deformed or damaged as a result.

It can be known from the above that the slide rail assembly 20 according to the foregoing embodiment of the present invention preferably has the following features:

1. The limiting feature 54 on the first rail 22 can prevent the elastic portion 50 from deformation by the force acting on the elastic portion 50, and this helps enhance the reliability in use of the slide rail assembly 20.
2. The size of the predetermined feature 52 is substantially larger than that of the engaging feature 42.

3. The main body portion 58, the elastic portion 50, and the supporting section 68 may be integrated into one unit in order for the retaining member 28 to be a single component.

While the present invention has been disclosed by way of the preferred embodiment described above, the embodiment is not intended to be restrictive of the scope of the invention. The scope of the patent protection sought by the applicant is defined by the appended claims.

What is claimed is:

1. A slide rail assembly, comprising:

a first rail including a top wall, a bottom wall displaced vertically from the top wall, and a longitudinal wall connected between the top wall and the bottom wall, wherein the top wall, the bottom wall, and the longitudinal wall of the first rail jointly define a channel;

a second rail movably mounted in the channel of the first rail, the second rail being longitudinally displaceable with respect to the first rail;

a slide-facilitating device movably mounted between the first rail and the second rail, the slide-facilitating device including an engaging feature, and a retaining member provided on the first rail, the retaining member including an elastic portion;

wherein the elastic portion of the retaining member includes a predetermined feature configured as a hole formed in said elastic portion, wherein the first rail includes a limiting feature configured as a projection portion disposed in a plane of the longitudinal wall of the first rail and extending from said bottom wall of the first rail in a vertical direction of said first rail, and wherein the limiting feature formed as the projection portion is configured to extend into said predetermined feature configured as the hole in said vertical direction of said first rail to prevent the elastic portion from moving in a transverse direction;

wherein when the second rail is moved out of the channel of the first rail after displacement in an opening direction with respect to the first rail, the slide-facilitating device is at a predetermined position, and the engaging feature of the slide-facilitating device is engaged with the predetermined feature of the elastic portion of the retaining member.

2. The slide rail assembly of claim 1, wherein the hole is defined by a plurality of hole walls.

3. The slide rail assembly of claim 1, wherein the retaining member further includes a main body portion connected to the longitudinal wall of the first rail; the elastic portion has a first end section and a second end section; the first end section of the elastic portion is connected to the main body portion; and the predetermined feature is provided at the second end section of the elastic portion.

4. The slide rail assembly of claim 3, wherein the second end section of the elastic portion includes a first guiding feature and a second guiding feature, and the predetermined feature is provided between the first guiding feature and the second guiding feature.

5. The slide rail assembly of claim 3, wherein the main body portion of the retaining member has a supporting section for supporting the elastic portion.

6. The slide rail assembly of claim 3, wherein the slide-facilitating device further includes a first portion, a second portion, and a longitudinal portion connected between the first portion and the second portion; the first portion, the second portion, and the longitudinal portion correspond to the top wall, the bottom wall, and the longitudinal wall of the first rail, respectively, wherein the first portion of the slide-facilitating device is provided with a plurality of rolling balls for supporting the top wall of the first rail, and wherein the second portion of the slide-facilitating device is provided with a plurality of rolling balls for supporting the bottom wall of the first rail.

7. The slide rail assembly of claim 1, wherein the predetermined feature is larger in size than the engaging feature.

8. The slide rail assembly of claim 1, wherein the second rail includes a releasing feature, wherein, while the second rail is being reinserted into the channel of the first rail from outside the channel of the first rail in a retracting direction, the elastic portion of the retaining member is moved by the releasing feature of the second rail such that the engaging feature of the slide-facilitating device is disengaged from the predetermined feature of the elastic portion of the retaining member to allow the slide-facilitating device to be displaced from the predetermined position in the retracting direction; wherein the second rail has a front end and a rear end, the releasing feature is adjacent to the rear end of the second rail, wherein the first rail has a front end and a rear end, wherein the retaining member is adjacent to the front end of the first rail, and wherein a distance between the releasing feature and the rear end of the second rail is greater than a distance between the retaining member and the front end of the first rail.

9. The slide rail assembly of claim 1, wherein the engaging feature of the slide-facilitating device is configured as an engaging hook.

10. A slide rail assembly, comprising:

a first rail including a top wall, a bottom wall displaced from said top wall in a vertical direction of said first rail, and a longitudinal wall connected between the top wall and the bottom wall of the first rail, wherein the top wall, the bottom wall, and the longitudinal wall of the first rail jointly define a channel;

a second rail movably mounted in the channel of the first rail, the second rail being longitudinally displaceable with respect to the first rail;

a slide-facilitating device movably mounted between the first rail and the second rail, the slide-facilitating device including an engaging feature; and a retaining member provided on the longitudinal wall of the first rail, the retaining member including an elastic portion;

wherein the elastic portion of the retaining member includes a hole, and wherein the longitudinal wall of the first rail includes a projecting portion disposed in a plane of the longitudinal wall of the first rail and extending from said bottom wall of the first rail in a vertical direction of said first rail, wherein said projection portion is configured to extend into the hole in said vertical direction of said first rail;

wherein, when the second rail is moved out of the channel of the first rail after displacement in an opening direction with respect to the first rail, the engaging feature of the slide-facilitating device extends into the space of the elastic portion of the retaining member to prevent the slide-facilitating device from arbitrary displacement with respect to the first rail.

11. The slide rail assembly of claim 10, wherein the hole is defined by a plurality of hole walls.

12. The slide rail assembly of claim 11, wherein the second rail includes a releasing feature, wherein, while the second rail is being reinserted into the channel of the first rail from outside the channel of the first rail in a retracting direction, the elastic portion of the retaining member is moved by the releasing feature of the second rail such that the engaging feature of the slide-facilitating device is disengaged from the space of the elastic portion of the retaining member to allow the slide-facilitating device to be displaced from a predetermined position in the retracting direction, wherein the second rail has a front end and a rear end, the releasing feature is adjacent to the rear end of the second rail, the first rail has a front end and a rear end, the retaining member is adjacent to the front end of the first rail, and wherein a distance between the releasing feature and the rear end of the second rail is greater than a distance between the retaining member and the front end of the first rail.

13. The slide rail assembly of claim 10, wherein the retaining member further includes a main body portion connected to the longitudinal wall of the first rail, the elastic portion has a first end section and a second end section, the first end section of the elastic portion is connected to the main body portion, and the hole is provided at the second end section of the elastic portion.

14. The slide rail assembly of claim 13, wherein the second end section of the elastic portion includes a first guiding feature and a second guiding feature, and the hole is provided between the first guiding feature and the second guiding feature.

15. The slide rail assembly of claim 13, wherein the main body portion of the retaining member has a supporting section for supporting the elastic portion.

16. The slide rail assembly of claim 13, wherein the slide-facilitating device further includes a first portion, a second portion, and a longitudinal portion connected between the first portion and the second portion, wherein the first portion, the second portion, and the longitudinal portion correspond to the top wall, the bottom wall, and the longitudinal wall of the first rail respectively, wherein the first portion of the slide-facilitating device is provided with a plurality of rolling balls for supporting the top wall of the first rail; and the second portion of the slide-facilitating device is provided with a plurality of rolling balls for supporting the bottom wall of the first rail.

17. The slide rail assembly of claim 10, wherein the hole is substantially larger in size than the engaging feature.

18. The slide rail assembly of claim 10, wherein the engaging feature of the slide-facilitating device is configured as an engaging hook.

19. The slide rail assembly of claim 10, wherein the elastic portion of the retaining member is provided with an extension section adjacent to the hole, and the engaging feature of the slide-facilitating device corresponds to the extension section when extending into the hole of the elastic portion of the retaining member.

* * * * *